US005124098A

United States Patent [19]

Vischer

[11] Patent Number: 5,124,098

[45] Date of Patent: Jun. 23, 1992

[54] PROCESS FOR PRODUCING FOAM FIBER

[75] Inventor: Axel Vischer, Augsburg, Fed. Rep. of Germany

[73] Assignee: Hoechst Aktiengesellschaft, Frankfurt am Main, Fed. Rep. of Germany

[21] Appl. No.: 665,680

[22] Filed: Mar. 7, 1990

[51] Int. Cl.[5] ..... B28B 11/18; C08J 9/08

[52] U.S. Cl. ..... 264/54; 264/165; 521/79; 521/81; 521/92; 521/97; 521/138; 521/182

[58] Field of Search ..... 521/138, 182, 92, 97, 521/79, 81; 264/54, 165

[56] References Cited

U.S. PATENT DOCUMENTS

| | | | |
|---|---|---|---|
| 3,884,030 | 5/1975 | Baxter et al. | 428/397 |
| 4,164,603 | 8/1979 | Siggel et al. | 428/398 |
| 4,425,443 | 1/1984 | Georlette et al. . | |
| 4,544,594 | 10/1985 | Li et al. | 428/92 |
| 4,572,740 | 2/1986 | Kretzschmann et al. . | |
| 4,588,754 | 5/1986 | Liu | 521/138 |

FOREIGN PATENT DOCUMENTS

| | | |
|---|---|---|
| 0059495 | 9/1982 | European Pat. Off. . |
| 0158212 | 10/1985 | European Pat. Off. . |
| 2550081 | 4/1977 | Fed. Rep. of Germany . |
| 2550080 | 5/1977 | Fed. Rep. of Germany . |
| 2703051 | 7/1978 | Fed. Rep. of Germany . |
| 103375 | 1/1974 | German Democratic Rep. . |
| 1543423 | 4/1979 | United Kingdom . |
| 1558308 | 12/1979 | United Kingdom . |

*Primary Examiner*—Morton Foelak

[57] ABSTRACT

There is described a process for producing polyester foam fiber where sodium carbonate and citric acid are added as blowing agent before spinning together with polycarbonate. The proportion of blowing agent is from 0.15 to 0.80 percent by weight of the polyester and the proportion of polycarbonate is from 0.5 to 2 percent by weight of the polyester. The process of the invention makes it possible to produce foam fiber, i.e. filament or staple fiber with discontinuous voids, which may be used for example as carpet fiber and filling fiber for blankets and cushions or as a lining material for winter clothing.

13 Claims, No Drawings

PROCESS FOR PRODUCING FOAM FIBER

The invention relates to a process for producing foam fiber as classified in the preamble of claim 1.

Foam fiber, i.e. fiber in filament or staple form with discontinuous voids, is used as carpet fiber and also as filling fiber for blankets and cushions or as a lining material for anoraks and other winter clothing. An advantage of foam fiber is its low density and hence the relatively large volume of filling material per unit weight. To obtain a noticeable reduction in density, the ready-produced, crimped foam fiber should have a void content of about 15%. Since the void content decreases on drawing, the void content after spinning must be appropriately larger. As regards crimping, the void spaces must be sufficiently stable to crushing. A process for producing foam fiber from a synthetic high polymer, a blowing agent and an additive is known from DE Auslegeschriften 2,550,080 and 2,550,081. In these prior art processes the high polymer used is a polyester such as polyethylene terephthalate or a polyamide such as nylon-6 or nylon-66. The blowing, i.e. gas-forming, agent used is a low-boiling hydrocarbon such as pentane or hexane or a hydrocarbon which is gaseous at room temperature such as propane or butane. The additive used is a silicone oil which is said to improve the spinnability of the polymer, increase the lifetime of the spinning die and ensure uniform distribution of the voids.

DD Patent 103,375 discloses a process for producing foam fiber from isotactic polypropylene wherein the blowing agent used is sodium bicarbonate and citric acid and the additive used is again silicone oil.

Sodium bicarbonate and citric acid are also used as blowing agent in the production of foamed plastics, for example structural foam moldings; cf. for example EP 0 059 495 and 0 158 212. The plastics mentioned therein also include, inter alia, various high polymers such as polyester. Even though sodium carbonate and citric acid do give good foam formation with polyesters, it has been found that this blowing agent damages the polyester. For example, it has been found that the intrinsic viscosity decreases by 0.15 units from a starting level of approximately 0.65, which corresponds to a molecular weight degradation of more than 20%.

It is an object of the present invention to provide a process for producing foam fiber from a synthetic high polymer, in particular polyester, a blowing agent and an additive whereby efficient foaming is achieved without damage to the high polymer.

This object is achieved by the process defined in claim 1.

The use of polycarbonate in the production of polyester fiber is already known from DE Offenlegungsschrift 2,703,051. In this process, the polyester to be spun is admixed before spinning with 3 to 20 percent by weight of a polycarbonate in order to increase the water retention capacity due to voids in the fiber.

In the process of the present invention, by contrast, sodium bicarbonate, citric acid and polycarbonate are mixed into the high polymer. It has been found, surprisingly, that the addition of polycarbonate counteracts the degradation in the melt viscosity of the polyester which would otherwise occur. Thus, the degradation in molecular weight of polyester from the starting polymer to the ready-produced foam fiber has been found to be less than 5%. The use of sodium bicarbonate and citric acid as blowing agent has the advantage that these substances only decompose at high temperatures and are toxicologically safe. Similarly, polycarbonate has the advantage of toxicological safeness.

Advantageously, the blowing agent of sodium bicarbonate and citric acid is added in an amount of from 0.15 to 0.80 percent by weight of the high polymer and the polycarbonate is added in an amount of from 0.5 to 2 percent by weight of the high polymer.

A blowing agent of sodium bicarbonate and citric acid suitable for the purposes of the present invention is any desired mixture of alkali metal bicarbonate and citric acid, preferably in a weight ratio of from 1:3 to 3:1.

Preferably, the blowing agent content is from 0.15 to 0.4 percent by weight in the case of polyethylene terephthalate and from 0.3 to 0.6 percent by weight in the case of polybutylene terephthalate. The preferred polycarbonate content is in both cases from 1.0 to 1.5 percent by weight. With polybutylene terephthalate the level of blowing agent and polycarbonate required is somewhat higher than with polyethylene terephthalate.

The level of other substances in the polyester should be as small as possible.

A further embodiment of the present invention provides that the high polymer, the flowing agent and the polycarbonate be mixed in chip form - before melting - with the blowing agent being added in the form of a masterbatch, in particular in a polyolefin. The mixing of the three components may take place for example in the feed line leading to the extruder.

The process of the present invention gives foam fiber having good processing properties (as continuous filament or staple) as carpet material and also as filling material for clothing. Such carpet or filling fiber material is produced by melt spinning and drawing in a conventional manner; slight adjustment of the process parameter may be necessary on the basis of routine experiments. When processing foam fiber in thermal processes it is well to bear in mind that the insulating effect of the voids also results in slower heating of the foam fiber.

EXAMPLES A

In a polyester fiber spinning plant, polyethylene terephthalate granules, dried in a conventional manner, are mixed with sodium bicarbonate and citric acid in the form of a blowing agent masterbatch (HOSTATRON P 1941) and polycarbonate (MAKROLON 16063068), and the mixture is extruded and spun through round-hole spinning dies.

| Spinning conditions | A1 | A2 | A3 | A4 | A5 | A6 |
|---|---|---|---|---|---|---|
| Hole diameter (mm) | 0.8 | 0.8 | 0.8 | 0.8 | 0.8 | 0.8 |
| dtex as spun | 30 | 30 | 30 | 30 | 30 | 30 |
| Spinning temperature (°C.) | 285 | 285 | 285 | 285 | 285 | 285 |
| Take-off speed (m/min) | 1000 | 1000 | 1000 | 1000 | 1000 | 1000 |
| Hostatron P 1941 (% by weight of polyester) | — | 0.6 | — | 0.6 | 0.6 | 1.0 |
| Polycarbonate | — | — | 1.0 | 1.0 | 2.0 | 1.0 |

-continued

| Spinning conditions | A1 | A2 | A3 | A4 | A5 | A6 |
|---|---|---|---|---|---|---|
| (% by weight of polyester) | | | | | | |
| Result | 1.34 | 1.31 | 1.34 | 0.97 | 0.92 | 0.92 |
| Density of fiber ($g/cm^3$) | | | | | | |

The density of the fiber is a measure of the expansion of the fiber The Examples show that only the chosen combination of blowing agent and polycarbonate gives a significant reduction in the density, i.e a significant void content of the fiber.

EXAMPLES B

The same starting materials are used as in Examples A, the blowing agent HOSTATRON P 1941 being added in an amount of 0.6 percent by weight and the polycarbonate in an amount of 1 percent by weight of the polyester. These Examples are concerned with the investigation of spinning dies of various hole diameters and of various spinning temperatures and take-off speeds.

| Spinning conditions | B1 | B2 | B3 | B4 | B5 | B6 |
|---|---|---|---|---|---|---|
| Hole diameter (mm) | 0.4 | 0.8 | 1.0 | 1.2 | 0.8 | 0.8 |
| dtex as spun | 30 | 30 | 30 | 30 | 30 | 21 |
| Spinning temperature (°C.) | 285 | 285 | 285 | 285 | 295 | 285 |
| Take-off speed (m/min) | 1000 | 1000 | 1000 | 1000 | 1000 | 1400 |
| Result | 1.02 | 0.97 | 0.95 | 0.92 | 0.92 | 0.97 |
| Density of fiber ($g/cm^3$) | | | | | | |

EXAMPLES C

The starting materials are the same as in Examples A and B. Instead of a spinning die with a round hole cross-section, a hollow profile spinning die is used.

| Spinning conditions | C1 | C2 |
|---|---|---|
| dtex as spun | 17 | 17 |
| Spinning temperature (°C.) | 287 | 287 |
| Take-off speed (m/min) | 1300 | 1300 |
| Hostatron P 1941 | — | 0.6 |
| (% by weight of polyester) | | |
| Polycarbonate | — | 1.0 |
| (% by weight of polyester) | | |
| Result | 1.10 | 0.80 |
| Density of fiber ($g/cm^3$) | | |

EXAMPLES D

The same blowing agent and the same additive are used as in the preceding series of examples. Instead of polyethylene terephthalate granules, however, polybutylene terephthalate granules are used.

| Spinning conditions | D1 | D2 | D3 |
|---|---|---|---|
| Hole diameter (mm) | 1.2 | 1.2 | 1.2 |
| dtex as spun | 37 | 37 | 37 |
| Spinning temperature (°C.) | 267 | 267 | 267 |
| Take-off speed (m/min) | 1000 | 1000 | 1000 |
| Hostatron P 1941 | 0.6 | 1.0 | 1.3 |
| (% by weight of polyester) | | | |
| Polycarbonate | 0.6 | 1.0 | 1.3 |
| (% by weight of polyester) | | | |
| Result | 1.26 | 1.15 | 1.04 |
| Density of fiber ($g/cm^3$) | | | |

As is evident from the table, in the case of polybutylene terephthalate only a higher level of blowing agent and polycarbonate than required for polyethylene terephthalate leads to a corresponding reduction in the fiber density.

I claim:

1. A process for producing foam fiber from a synthetic polyester, a blowing agent, and an additive, which process comprises:

admixing into the polyester an alkali metal bicarbonate and citric acid, as a blowing agent, and an effective amount, sufficient to reduce degradation of the melt viscosity of the polyester which occurs when the polyester is in the molten state, of a polycarbonate different from the aforesaid polyester, and spinning the resulting mixture, with expansion, to obtain the foam fiber.

2. The process of claim 1, wherein the level of blowing agent is from 0.15 to 0.80 percent by weight of the polyester.

3. The process of claim 2, wherein the polyester is polyethylene terephthalate and the level of blowing agent is from 0.15 to 0.4 percent by weight of the polyester.

4. The process of claim 2, wherein the polyester is polybutylene terephthalate and the level of blowing agent is from 0.3 to 0.6 percent by weight of the polyester.

5. The process of claim 1, wherein the level of polycarbonate is from 1.0 to 1.5 percent by weight of the polyester.

6. The process of claim 1, wherein the effective amount of polycarbonate is 0.5 to 2% by weight, based on the weight of the polyester.

7. The process of claim 1, wherein the blowing agent is a mixture consisting essentially of sodium bicarbonate and citric acid in the sodium bicarbonate:citric acid weight ratio of from 1:3 to 3:1.

8. The process of claim 1, wherein the polyester is polyethylene terephthalate or polybutylene terephthalate.

9. The process as claimed in claim 1, wherein the foam fiber is produced by extruding and spinning said resulting mixture.

10. The process as claimed in claim 1, wherein the foam fiber is produced by melt-spinning and drawing said resulting mixture.

11. The process as claimed in claim 1 wherein polyester, a blowing agent, and polycarbonate are first mixed and then melted.

12. The process as claimed in claim 11, wherein polyester, blowing agent, and polycarbonate are mixed in chip form before melting, the flowing agent being added in the form of a masterbatch.

13. The process of claim 12, wherein the blowing agent masterbatch includes a polyolefin.

* * * * *